US007063539B2

(12) United States Patent
Ho et al.

(10) Patent No.: US 7,063,539 B2
(45) Date of Patent: Jun. 20, 2006

(54) MEMORY CARD CONNECTOR WITH AUXILIARY PRINTED CIRCUIT BOARD

(75) Inventors: Yi-Tse Ho, Tainan (TW); Katsutoshi Tojo, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/953,233

(22) Filed: Sep. 29, 2004

(65) Prior Publication Data

US 2005/0079766 A1 Apr. 14, 2005

(30) Foreign Application Priority Data

Oct. 14, 2003 (TW) ..... 92218266 U

(51) Int. Cl.
*H01R 12/00* (2006.01)

(52) U.S. Cl. ..... 439/64; 439/541.5

(58) Field of Classification Search ..... 439/64, 439/159, 541.5, 79
See application file for complete search history.

(56) References Cited

U.S. PATENT DOCUMENTS 5,688,130 A * 11/1997 Huang ..... 439/79
5,954,522 A * 9/1999 Ho et al. ..... 439/79
6,027,365 A * 2/2000 Kaufman ..... 439/489
6,045,366 A * 4/2000 Motomu ..... 439/64
6,174,197 B1 * 1/2001 Hirata et al. ..... 439/541.5
6,227,874 B1 * 5/2001 Yu ..... 439/79
RE38,089 E * 4/2003 Kajiura ..... 439/64

* cited by examiner

*Primary Examiner*—Gary F. Paumen
(74) *Attorney, Agent, or Firm*—Charles S. Cohen

(57) ABSTRACT

A memory card connector is provided for mounting on a main printed circuit board having a header connector thereon. The connector includes an insulating housing having a rear terminal-mounting section and at least one longitudinal side wall section extending forwardly from one end of the rear section and combining therewith to define a card-receiving space. An array of first terminals are mounted on the rear section and have contact portions projecting into the space for engaging appropriate contacts on a memory card, along with tail portions exposed on the housing. An auxiliary printed circuit board is mounted on the housing and has an array of circuit traces electrically engaged with the tail portions of the terminals. The auxiliary printed circuit board has a mating portion for insertion into the header connector on the main printed circuit board. The mating portion has contact pads electrically coupled to the circuit traces on the auxiliary printed circuit board.

17 Claims, 4 Drawing Sheets

MEMORY CARD CONNECTOR WITH AUXILIARY PRINTED CIRCUIT BOARD

FIELD OF THE INVENTION

This invention generally relates to the art of electrical connectors and, particularly, to a memory card connector for mounting on a printed circuit board, the connector itself mounting an auxiliary printed circuit board.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smartphones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like. The connector terminals typically have tail portions for connection to appropriate circuit traces on the printed circuit board. The tail portions may be connected to the circuit traces by surface mount technology, wherein the tail portions are soldered to the circuit traces. The tails portions may be inserted into through holes in the circuit board for connection, as by soldering, to circuit traces on the board and/or in the holes. In either process, the solder connections involve high temperatures in a reflow process. In other instances, the tail portions simply may be electrically connected to the circuit traces by pressure engagement. This often is accomplished by using screws or other fasteners which run through the connector housing to tightly clamp the housing to the printed circuit board. In all of these processes or systems, problems are encountered when the connections between the tail portions and the circuit traces become loosened or otherwise damaged or the tail portions even becoming separated from the circuit traces. This results in incomplete connections and defective circuitry. The defective connections can be caused by the circuit board bending or warping, for instance.

The above problems are multiplied when the memory card connector is designed for receiving more than one memory card, such as two different types of memory cards. The present invention is directed to solving these problems by providing the memory card connector with an auxiliary printed circuit board which mates with a header connector on the main printed circuit board and, thereby, eliminates the connections between tail portions of the terminals on the memory card connector and circuit traces on the main printed circuit board.

SUMMARY OF THE INVENTION

An object, therefore, of the invention is to provide a new and improved memory card connector of the character described.

Another object of the invention is to provide a new and improved memory card connector for mounting on a main printed circuit board having a header connector thereon.

In the exemplary embodiment of the invention, the connector includes an insulating housing having a rear terminal-mounting section and at least one longitudinal side wall section extending forwardly from one end of the rear section and combining therewith to define a card-receiving space. An array of first terminals are mounted on the rear section and have contact portions projecting into the space for engaging appropriate contacts on a memory card, along with tail portions exposed on the housing. An auxiliary printed circuit board is mounted on the housing and has an array of circuit traces electrically engaged with the tail portions of the terminals. The auxiliary printed circuit board has a mating portion for insertion into the header connector on the main printed circuit board. The mating portion has conductors electrically coupled to the circuit traces on the auxiliary printed circuit board.

According to one aspect of the invention, the housing includes a pair of rear side wall sections extending rearwardly from opposite ends of the rear terminal-mounting section and between which the auxiliary printed circuit board is mounted. A terminal tail alignment plate is mounted between the pair of rear side wall sections and includes alignment holes through which the tail portions of the terminals project. The auxiliary printed circuit board is mounted to the terminal tail alignment plate. As disclosed herein, the auxiliary printed circuit board is oriented generally vertically, with the mating portion projecting downwardly for insertion into the header connector on the main printed circuit board. The terminal tail alignment plate is mounted between the auxiliary printed circuit board and the rear of the housing.

According to another aspect of the invention, a metal terminal cover is mounted over the rear of the housing. The auxiliary printed circuit board is disposed between the metal terminal cover and the terminal tail alignment plate.

The invention contemplates that the insulating housing of the memory card connector be adapted for receiving a pair of different types of memory cards. Therefore, an array of second terminals are mounted on the rear section of the housing and have tail portions electrically engaged with a second array of circuit traces on the auxiliary printed circuit board. A metal baffle plate is mounted on the housing in position between the two memory cards to provide electromagnetic interference protection between the cards.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
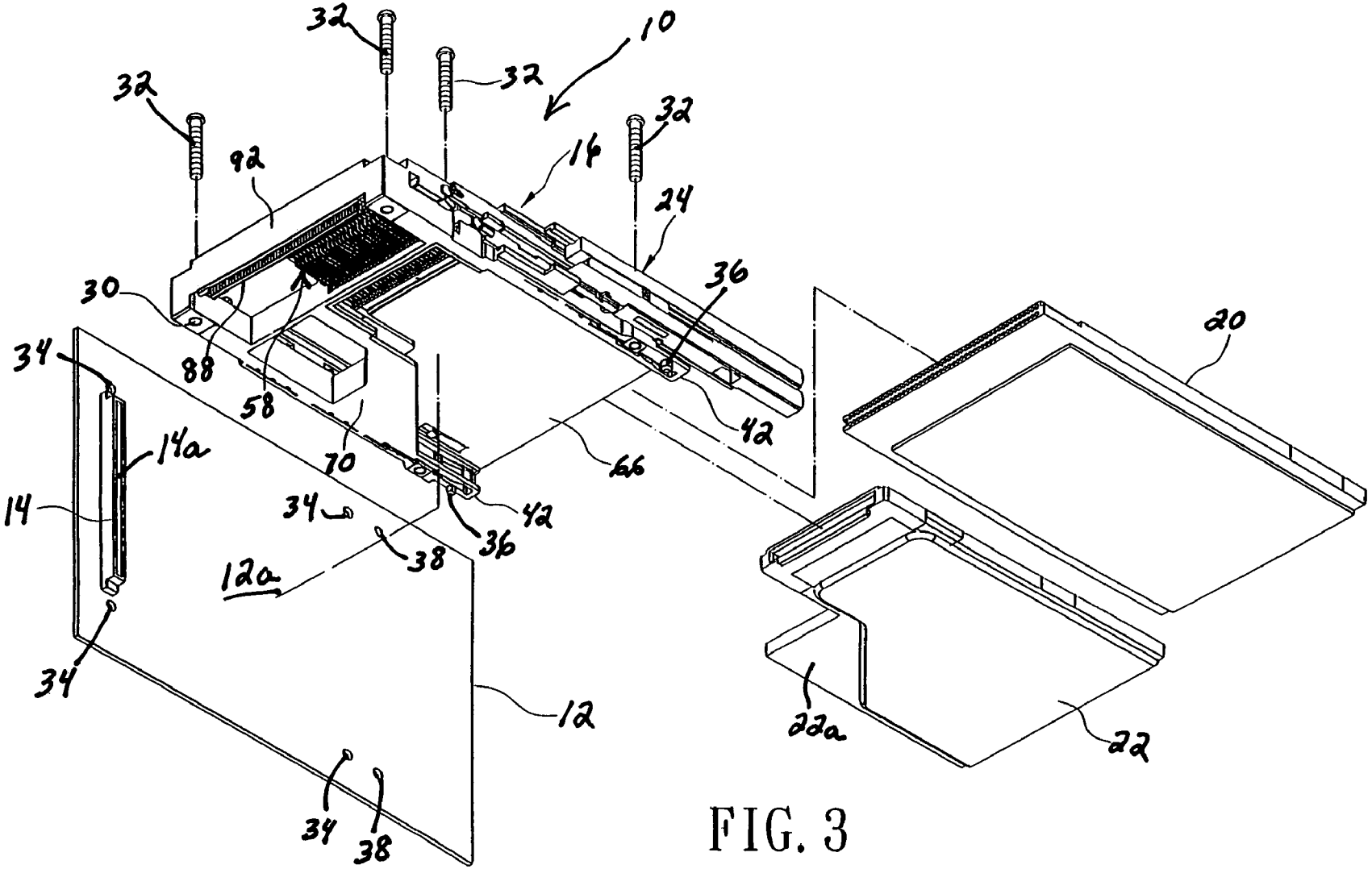
FIG. 3 is a bottom perspective view of the connector in assembled condition, in conjunction with a main printed circuit board, a plurality of fasteners for securing the connector to the board and a pair of different types of memory cards.

Referring to the drawings in greater detail, the invention is embodied in a memory card connector, generally designated 10, which is mountable on top of a main printed circuit board 12 (FIG. 3). An elongated header connector 14 is mounted on a top surface 12*a* of the main printed circuit board. The header connector has an elongated mating slot 14*a*.

Figure 1:
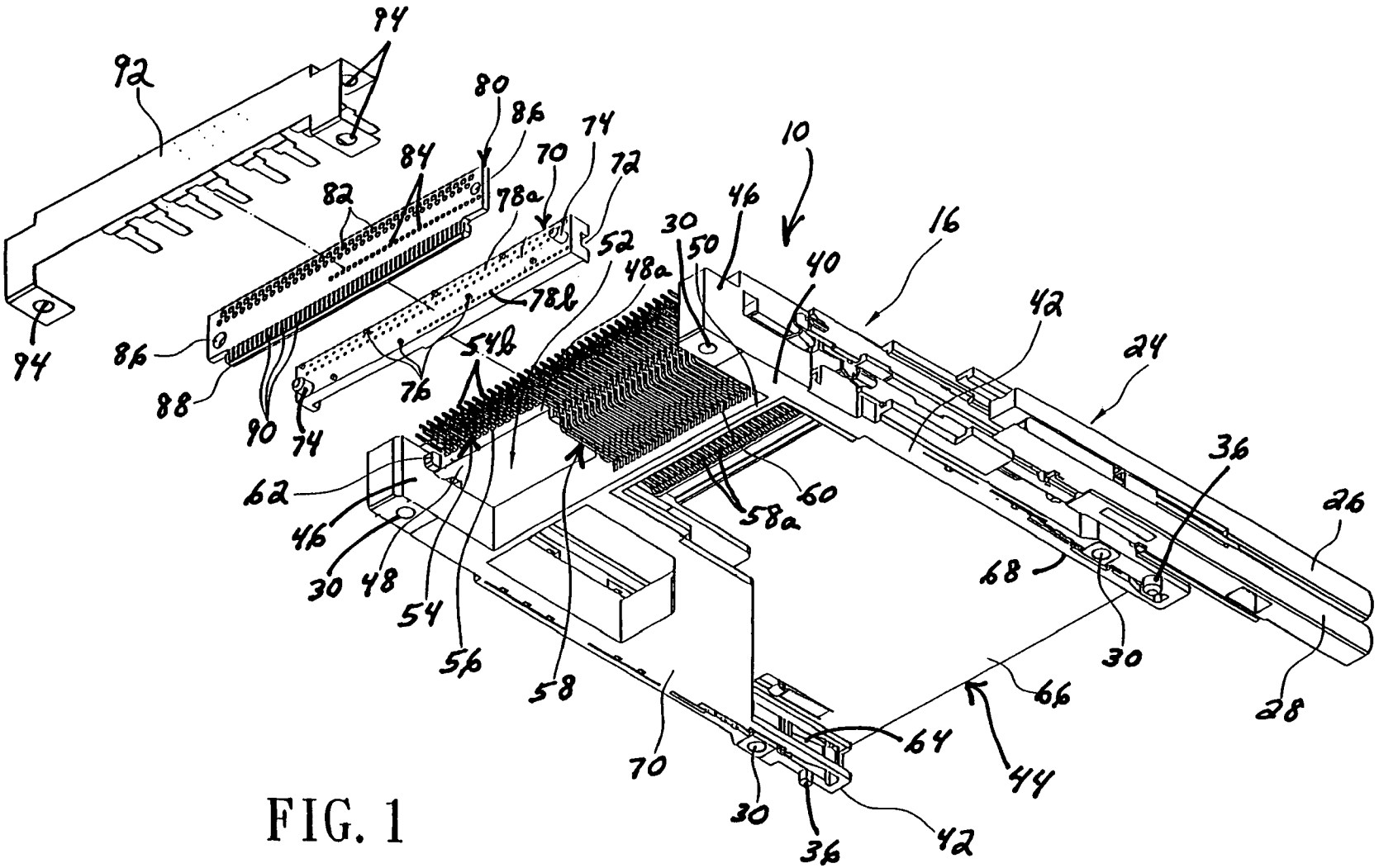
FIG. 1 is a bottom exploded perspective view of a memory card connector embodying the concepts of the invention.
Figure 2:
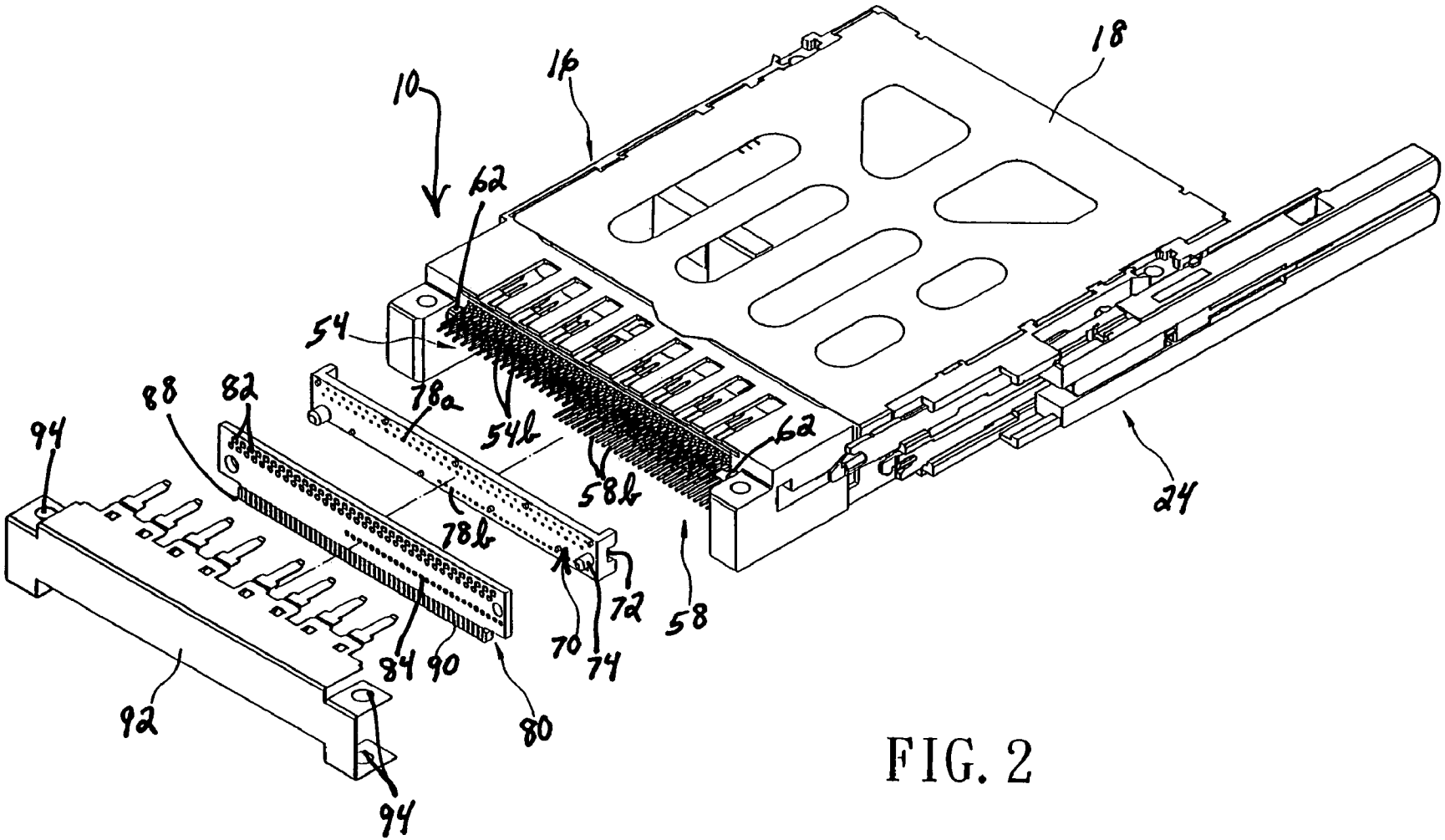
FIG. 2 is an exploded top perspective view of the connector.

Referring particularly to FIGS. 1 and 2, memory card connector 10 includes an insulating or dielectric housing, generally designated 16, which may be molded of plastic material. A metal shell or shield 18 (FIG. 2) is mounted to and substantially covers the housing. The connector is of a configuration which receives two different types of memory cards 20 and 22 (FIG. 3). An eject mechanism, generally designated 24, is mounted at one side of the housing and includes a pair of ejecting arms 26 and 28, respectively, for ejecting memory cards 20 and 22, respectively. The housing has four through holes 30 for receiving four fasteners 32 (FIG. 3) therethrough. In the illustrated embodiment, the fasteners are screws which extend through holes 30 and are fastened into four fastening holes 34 in main printed circuit board 12. A pair of mounting posts 36 project downwardly from the housing for insertion into a pair of mounting holes 38 in the main printed circuit board.

Insulating housing 16 of connector 10 includes a rear terminal-mounting section 40 and a pair of side wall sections 42 extending forwardly from opposite sides of the rear section and combining therewith to define a card-receiving space, generally designated 44 (FIG. 1). A pair of rear side wall sections 46 project rearwardly from opposite ends of rear section 40. The rear section includes a first wall 48, a second wall 50 and a recessed area, generally designated 52. A linear array of first terminals, generally designated 54, are mounted through a plurality of terminal-receiving passages 56 in first wall 48. An array of second terminals, generally designated 58, are mounted in a linear array of terminal-receiving passages 60 in second wall 50. A pair of mounting bosses 62 project rearwardly from a rear face of first wall 48.

Each forwardly extending side wall section 42 of housing 16 includes a pair of upper and lower longitudinal grooves 64 for receiving the two memory cards 20 and 22. The lower groove 64 is quite visible in FIGS. 1 and 3, but the upper groove is not visible because of the presence of a metal baffle plate 66. The metal baffle plate is positioned in a pair of grooves 68 in the inside faces of the side walls sections between the upper and lower grooves 64 to separate the memory card connectors and to provide electromagnetic interference protection between the memory cards. The housing has a slotted support structure 70 on the underside thereof inside one of the side wall sections for receiving a triangulated portion 22*a* (FIG. 3) of the second memory card 22.

As stated above, first terminals 54 are mounted within passages 56 in first wall 48 of the rear terminal-mounting section of the housing. The first terminals have contact portions (not visible in the drawings) for engaging appropriate contacts on the first memory card 20. The first terminals include tail portions in the form of terminal pins 54*b* which project rearwardly of rear face 48*a* of first wall 48. Second terminals 58 have contact portions 58*a* which project forwardly into space 44 for engaging appropriate contacts on the second memory card 22. The second terminals have tail portions in the form of terminal pins 58*b* (FIG. 2) which project rearwardly and generally parallel to terminal pins 54*b* of first terminals 54.

An elongated, generally vertically oriented, terminal tail alignment plate, generally designated 70, is mounted at the rear of housing 16 between the rear side wall sections 46. The alignment plate has a pair of mounting notches 72 at opposite ends thereof for press-fitting on mounting bosses 62 which project rearwardly of the housing. In turn, the alignment plate has a pair of rearwardly projecting mounting posts 74 for purposes described hereinafter, along with a plurality of smaller spacer posts 76 which also project rearwardly. The alignment plate includes a first linear array of alignment holes 78*a* and a shorter linear array of alignment holes 78*b* which extends through the plate for receiving therethrough the tail portions or terminal pins 54*b* and 58*b*, respectively, of the first and second terminals 54 and 58, respectively. By inserting the tail portions or terminal pins through the alignment plate, the pins are maintained in proper alignment or pitch.

An auxiliary printed circuit board, generally designated 80, is mounted at the rear of connector housing 16 and includes a first, longer linear array of through holes 82 and a second, shorter linear array of through holes 84. Terminal pins 54*b* of first terminals 54 are inserted through holes 82, and terminal pins 58*b* of second terminals 58 are inserted into holes 84. The terminal pins are electrically connected to respective circuit traces on the board and/or in the holes. The pin alignment plate includes a pair of mounting holes 86 at opposite ends thereof for mounting onto mounting posts 74 of tail alignment plate 70. The auxiliary printed circuit board includes a mating portion in the form of an elongated tongue 88 for insertion into the mating slot 14*a* (FIG. 3) of header connector 14 on main printed circuit board 12. Contact pads 90 are located on one or both sides of mating portion 88 of the auxiliary printed circuit board and are electrically coupled by circuitry on the board to the circuit traces in holes 82 and 84 which are electrically coupled to terminal pins 54*b* and 58*b*.

A metal terminal cover 92 is positioned over the rear of housing 16 and over auxiliary printed circuit board 80, as well as over the terminal pins which project through the holes in the auxiliary printed circuit board. The metal terminal cover has a plurality of holes 94 for receiving the two rear-most screws 32 (FIG. 3) therethrough.

When connector 10 is assembled as shown in FIG. 3, terminal tail alignment plate 70 first is assembled between the rear side wall sections 46 of housing 16 by positioning mounting slots 72 of the alignment plate over mounting bosses 62 of the housing, with the tail portions of the terminals projecting through the alignment holes 78*a* and 78*b* in the plate. Auxiliary printed circuit board 80 then is mounted to the rear of the tail alignment plate by inserting holes 86 in the auxiliary circuit board over mounting posts 74 of the alignment plate. The smaller spacer posts 76 on the alignment plate slightly space the auxiliary printed circuit board from the plate. Metal terminal cover 92 then is positioned over the rear of housing 16 to align holes 94 in the terminal cover with the rear-most through holes 30 in the housing. Screws 32 then are inserted through this subassembly which is mounted onto top surface 12*a* of main printed circuit board 12. As the assembled connector is mounted on top of the main printed circuit board, mating portion 88 of auxiliary printed circuit board 80 is inserted into mating slot 14*a* on the main printed circuit board. Screws 32 then are tightened to secure the memory card connector to the main printed circuit board.

Figure 4:
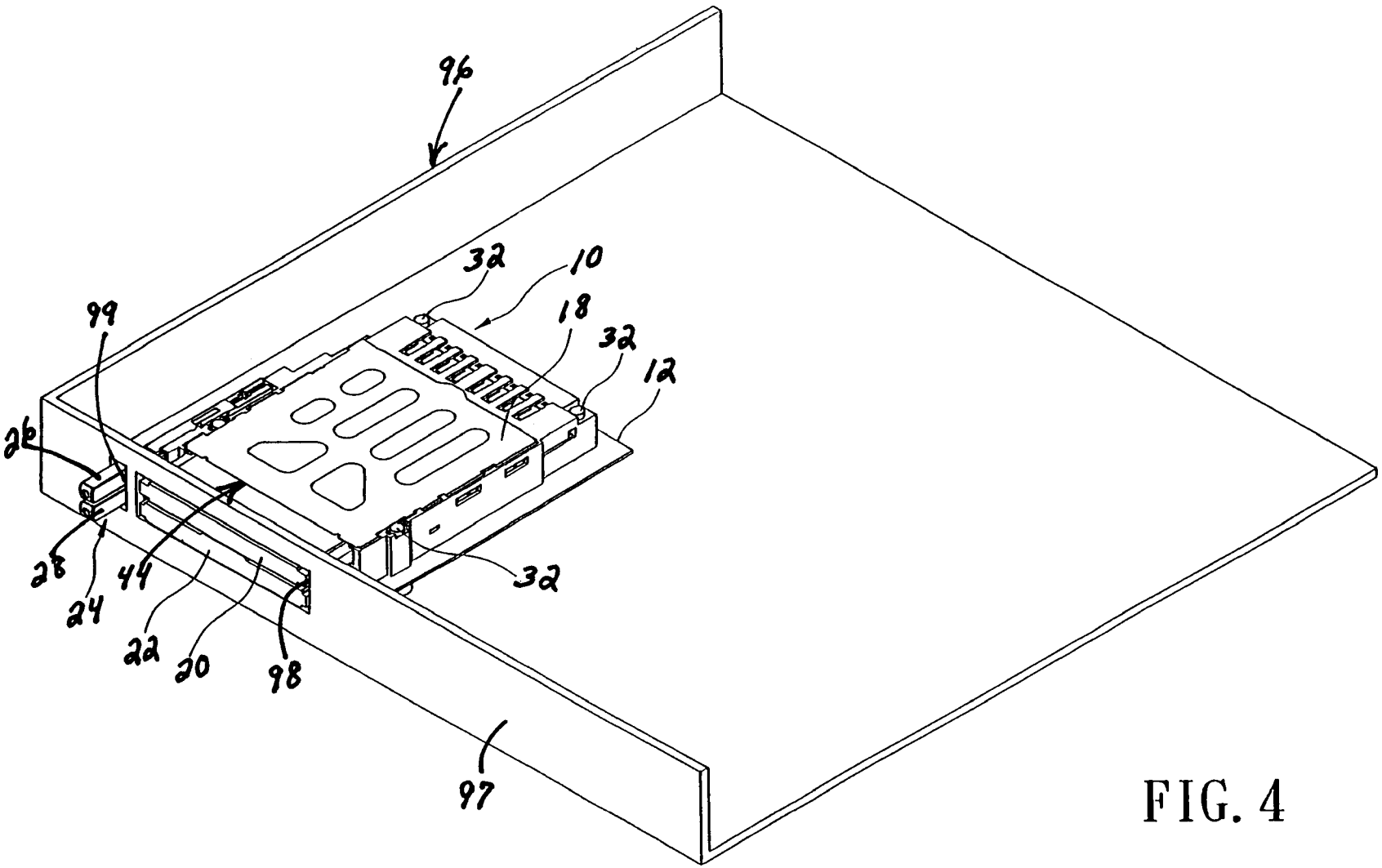
FIG. 4 is a perspective view of the connector mounted in a support structure or chassis of an electrical appliance.

FIG. 4 shows memory card connector 10 mounted in a support structure or chassis, generally designated 96, of an electrical appliance. The chassis has an outer wall 97 which includes an elongated opening 98 and a smaller opening 99. First and second memory cards 20 and 22 are shown as having been inserted through opening 98 and into the card-receiving space 44 of memory card connector 10. Ejecting arms 26 and 28 of eject mechanism 24 are shown projecting through opening 72 and exposed for manual manipulation by an operator.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A memory card connector for mounting on a main printed circuit board having a header connector thereon, comprising:

an insulating housing having a rear terminal-mounting section and at least one longitudinal side wall section extending forwardly from one end of the rear section and combining therewith to define a card-receiving space;

an array of first terminals mounted on the rear terminal-mounting section of the housing and having contact portions projecting into said space for engaging appropriate contacts on a first memory card and tail portions exposed on the housing;

an array of second terminals mounted on the rear terminal-mounting section of the housing and having contact portions projecting into said space for engaging appropriate contacts on a second memory card and tail portions exposed on the housing;and an auxiliary printed circuit board mounted on the housing and having arrays of circuit traces electrically engaged with the tail portions of the first and second terminals, respectively, the auxiliary printed circuit board having a mating portion for insertion into the header connector on the main printed circuit board, the mating portion having contact pads electrically coupled to the circuit traces on the auxiliary printed circuit board, said auxiliary printed circuit board being oriented in a generally vertical plane at the rear of the housing with the mating portion projecting downwardly for insertion into the header connector on the main printed circuit board: and a terminal tail alignment plate having alignment holes through which the tail portions of the terminals project. the alignment plate being mounted between the auxiliary printed circuit board and the rear of the housing.

2. The memory card connector of claim 1 wherein said housing includes a pair of rear side wall sections extending rearwardly from opposite ends of the rear terminal-mounting section and between which the auxiliary printed circuit board is mounted.

3. The memory card connector of claim 1 wherein said auxiliary printed circuit board is mounted to the terminal tail alignment plate.

4. The memory card connector of claim 3, including a metal terminal cover mounted over the rear of the housing.

5. The memory card connector of claim 4 wherein said auxiliary printed circuit board is disposed between the metal terminal cover and the terminal tail alignment plate.

6. The memory card connector of claim 1, including a metal baffle plate mounted on the housing in position between a pair of memory cards to provide electromagnetic interference protection between the memory cards.

7. The memory card connector of claim 1 wherein said auxiliary printed circuit board is mounted to the terminal tail alignment plate.

8. The memory card connector of claim 7, including a metal terminal cover mounted over the rear of the housing.

9. The memory card connector of claim 8 wherein said auxiliary printed circuit board is disposed between the metal terminal cover and the terminal tail alignment plate.

10. A memory card connector for mounting on a main printed circuit board having a header connector thereon, comprising:

an insulating housing having a rear terminal-mounting section and at least one longitudinal side wall section extending forwardly from one end of the rear section and combining therewith to define a card-receiving space;

an array of terminals mounted on the rear terminal-mounting section of the housing and having contact portions projecting into said space for engaging appropriate contacts on a memory card and tail portions exposed on the housing; and an auxiliary printed circuit board mounted on the housing and having an array of circuit traces electrically engaged with the tail portions of the terminals, the auxiliary printed circuit board having a mating portion for insertion into the header connector on the main printed circuit board, the mating portion having contact pads electrically coupled to the circuit traces on the auxiliary printed circuit board, said auxiliary printed circuit board being oriented in a generally vertical plane at the rear of the housing with the matins portion projecting downwardly for insertion into the header connector on the main printed circuit board; and a terminal tail alignment plate having alignment holes through which the tail portions of the terminals project, the alignment plate being mounted between the auxiliary printed circuit board and the rear of the housing.

11. The memory card connector of claim 10 wherein said auxiliary printed circuit board is mounted to the terminal tail alignment plate.

12. The memory card connector of claim 11, including a metal terminal cover mounted over the rear of the housing.

13. The memory card connector of claim 12 wherein said auxiliary printed circuit board is disposed between the metal terminal cover and the terminal tail alignment plate.

14. A memory card connector for mounting on a main printed circuit board having a header connector thereon, comprising:

an insulating housing having a rear terminal-mounting section, at least one longitudinal side wall section extending forwardly from one end of the rear section and combining therewith to define a card-receiving space, and a pair of rear side wall sections extending rearwardly from opposite ends of the rear terminal-mounting section;

an array of terminals mounted on the rear terminal-mounting section of the housing and having contact portions projecting into said space for engaging appropriate contacts on a memory card and tail portions exposed on the housing; and an auxiliary printed circuit board mounted on the housing between said pair of rear side wall sections and having an array of circuit traces electrically engaged with the tail portions of the terminals, the auxiliary printed circuit board having a mating portion for insertion into the header connector on the main printed circuit board, the mating portion having contact pads electrically coupled to the circuit traces on the auxiliary printed circuit board.

15. The memory card connector of claim 14 wherein said auxiliary printed circuit board is mounted to the terminal tail alignment plate.

16. The memory card connector of claim 15, including a metal terminal cover mounted over the rear of the housing.

17. The memory card connector of claim 16 wherein said auxiliary printed circuit board is disposed between the metal terminal cover and the terminal tail alignment plate.

* * * * *